United States Patent [19]

Juhas

[11] 4,062,701

[45] Dec. 13, 1977

[54] METHOD OF FORMING END FLANGES

[75] Inventor: Joseph Aloysius Juhas, Litchfield, Conn.

[73] Assignee: The Torrington Company, Torrington, Conn.

[21] Appl. No.: 736,095

[22] Filed: Oct. 27, 1976

[51] Int. Cl.[2] ..... C21D 9/08

[52] U.S. Cl. ..... 148/12.1; 29/33 T; 29/DIG. 43; 29/159.3; 72/367; 72/370; 148/16.5; 148/154

[58] Field of Search ..... 148/12.1, 16.5, 154; 72/370, 367; 29/159.3, 33 T, DIG. 43

[56] References Cited

U.S. PATENT DOCUMENTS

| | | | |
|---|---|---|---|
| 540,314 | 6/1895 | Howell | 72/367 |
| 1,076,592 | 10/1913 | Manning | 24/DIG. 43 |
| 1,127,072 | 2/1915 | Morse | 148/12.1 |
| 1,421,507 | 7/1922 | Lindberg | 72/367 |
| 3,344,817 | 10/1967 | Connard | 148/16.5 |

*Primary Examiner*—W. Stallard
*Attorney, Agent, or Firm*—Frank S. Troidl

[57] ABSTRACT

The method is performed on a cylinder having at least one end opening for receiving a flange forming tool. An annular shoulder is formed extending from the outside of the cylinder substantially perpendicular to the axis of the cylinder. Also, an annular extension is provided on the cylinder having an outside surface extending from the inside of the annular shoulder to the end of the cylinder. The length of the outside surface is formed to be greater than the radial width of the annular shoulder. A flange forming tool is then applied against the free end of the annular extension to move the annular extension until its formerly outside surface is against the annular shoulder to provide an end flange extending substantially perpendicularly to the axis of the cylinder.

10 Claims, 5 Drawing Figures

METHOD OF FORMING END FLANGES

This invention is a method of forming cylindrical members with end flanges.

Practically all flanged members such as pins, studs, rollers, posts, and spacers are produced on screw machines from stock having an outside diameter at least as large as the diameter of the flange to be made with the center portion machined to the smaller diameter of the main body of the member. One disadvantage in the conventional methods of making flanged pins, studs, rollers, posts, spacers and so forth is that since the cylindrical member must have its central portion machined to the smaller body diameter, a large percentage of material is lost from the stock and wasted. Another disadvantage is that if better dimensional accuracy and surface finish than screw machine accuracy and finish are required, expensive "in-feed" grinding and polshing operations are necessary. For many uses the surface finish is critical and must be very low in microinch reading, requiring that the surface must be ground and/or lapped. Such, for example, is the situation with cassette posts over which pass the tapes of video and audio cassettes.

With conventional methods of forming spacers and posts with flanges on screw machines the element is usually ground in what is called "in-feed grinding" after the element body and its flanges are machined. In "in-feed grinding" each elemet is placed in front of the cylindrical surface of the rotating grinding wheel and the grinding wheel is moved radially toward the axis of the rotating cylindrical element to grind the element. When grinding is completed, the grinding wheel is backed away from the element and the element is ejected. Another element is then fed in, and the process is repeated. The maximum production rate for this type of grinding is probably about three feeds per minute, depending on the dimensional precision and quality of surface finish required. This, of course, is quite slow, even if several elements can be fed and ground simultaneously.

In practising the new method of this invention the body diameter and its surface finish are completed before the flanges are formed. Cylindrical blanks formed and shaped in accordance with this invention can be fed axially in a steady stream, one behind the other, through a centerless grinder and be ground at the rate of 200 to 1500 lineal inches per minute (axial length of the stream of blanks) depending upon the material itself and the dimensional accuracy and surface finish desired. Production rate of grinding and polshing the elements to be flanged is thus increased to many times greater than the rate of the "in-feed grinding" method.

Also, material is saved using this new method because the end extensions which are formed into flanges on the cylindrical members have a starting outside diameter no larger than the size of the outside diameter of the stock needed to make the cylindrical body section of the finished members.

Briefly described, the new method comprises shaping one end of a cylinder if only one end flange is to be made, and shaping both ends of the cylinder if two end flanges are to be made. This end shaping is done either before or after the body section of the element is machined and/or ground. The shaping of the end of the cylinder includes forming an annular shoulder extending from the outside of the cylinder substantially perpendicular to the axis of the cylinder and forming an annular extension from the shoulder to the end of the cylinder. The annular extension has an outside surface extending from the inside of the annular shoulder approximately to the end of the cylinder. The length of the radially outside surface of the extension is made greater than the radial width of the annular shoulder. Finally, a flange forming tool is applied against the free end of the annular extension to move the annular extension, first bending it radially outward and then axially inward until its former outside surface is against the annular shoulder, thus providing a flange extending substantially perpendicularly to the axis of the cylinder and radially outward beyond the cylindrical surface of the element body.

The invention, as well as its many advantages will be further understood by reference to the following detailed description and drawings in which.

Figure 1:
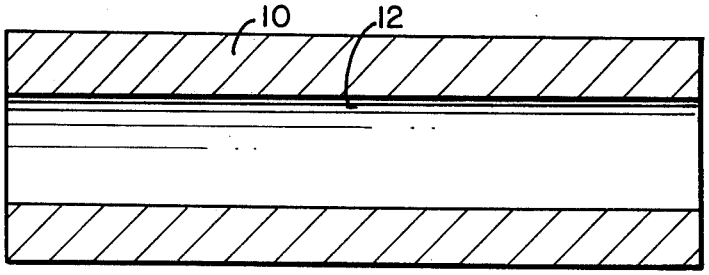
FIG. 1 is a sectional view of a cylindrical tubular blank from which the flanged member is to be made.

Referring to the figures, and more practicularly to FIG. 1, a tublular member 10 may be cut to a predetermined length from a long tube (not shown) or may be machined from a a solid rod (not shown).

Figure 2:
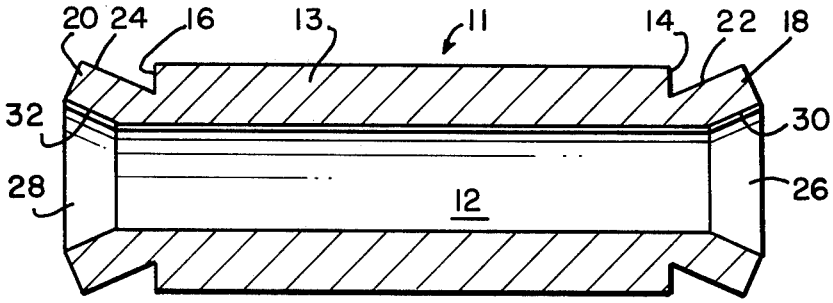
FIG. 2 is a sectional view showing a blank after it has been formed in preparation for the flange making operation.

The tubular member 10 includes a bore 12 which in the preferred embodiment shown in FIG. 1 extends entirely through the tubular member 10. FIG. 2 shows the blank 11 formed from the tube 10 of FIG. 1 by performing certain forming operations on its ends preparatory to the forming of the end flanges. A pair of longitudinally spaced annular shoulders 14 and 16 have been formed on the cylindrical tube. Each annular shoulder 14 and 16 extends from the outside of the blank radially substantially perpendicularly to the axis of the blank. Annular extensions 18 and 20 extend from annular shoulders 14 and 16, respectively, to the ends of the blank. The length of each outside surface 22 and 24 of the annular extensions 18 and 20, respectively, is greater than the radial width of each annular shoulder 14 and 16.

The blank 11 shown in FIG. 2 may have its end portions shaped by conventional screw machines and if desired, its cylindrical surface 13 may be machined and/or ground. Note that the outside conical surfaces of the annular extensions contact the insides of the annular shoulders at an acute angle and the outermost radial extent of the annular extensions 18 and 20 are always equal to or less than the outside diameter of the blank 11. Conical counterbores 26 and 28 having surfaces 30 and 32, respectively, which are substantially parallel to surfaces 22 and 24, respectively, are provided in blank 11 to control the thickness of the extensions 18 and 20.

Figure 3:
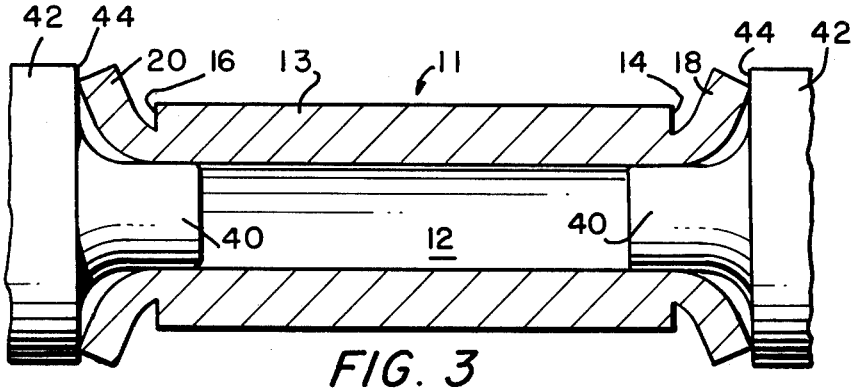
FIG. 3 is a view partly in section showing the insertion of the flange forming members into the ends of the blank.

FIG. 3 shows the insertion of forming tools into the ends of blank 11. Each forming tool includes a cylindrical portion 40 adapted to enter the bore of the blank.

The forming tool also includes a portion of larger diameter 42 thus providing an annular surface 44 which engages the free end of the annular extension 18 or 20, bending the extension axially inward toward the shoulder.

Figure 4:
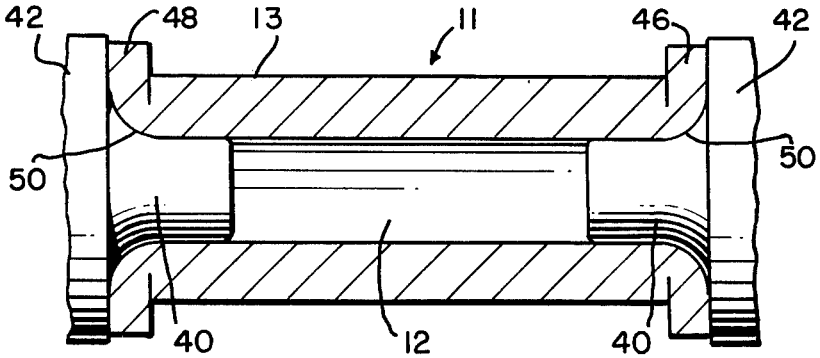
FIG. 4 is a view partly in section showing the complete insertion of the flange forming tools into the ends of the blank to form the flanges extending perpendicularly to the axis of the cylindrical member.

As shown in FIG. 4, the cylindrical portions 40 of the flange forming tools have been fully inserted into the bore 12, forming flanges 46 and 48. These and flanges each extend substantially perpendicularly to the axis of the blank 11 and extend radially outward beyond the cylindrical surface 13. The base of each of the cylindrical portions 40 is curved as at 50 to aid in the movement of the annular extensions 18 and 20 up against the corresponding annular shoulders 14 and 16, respectively. The controlled thickness of extensions 18 and 20 as shown in FIG. 2 help to provide the desired axial thickness of the finished flanges 46 and 48 shown in FIG. 4. The conical shape of the extensions 18 and 20 is adapted to aid in gathering enough thickness of material for a relatively thick flange. When a thinner flange is desirable or can be tolerated, the extensions may be made cylindrical and relatively thin-walled.

Figure 5:
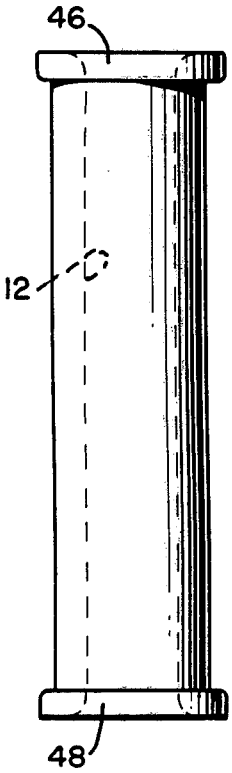
FIG. 5 is a view of a completed post for a cassette having a flange at each end. In the various figures, like parts are referred to by like numbers.

FIG. 5 shows a side view of completed cylindrical member with two flanges. The length between the inside surfaces of the flanges 46 and 48 is determined by the separation between the shoulders 14 and 16 of FIG. 2. The outside diameter and axial length or thickness of the end flanges 46 and 48 is determined by the length of the outside surfaces 22 and 24 and the configurations of the annular extensions 18 and 20. When the element is used a spacer which must have a closely controlled overall length as well as a controlled interior length between flanges, the control of the configuration of the extension is critical. In some cases the flanges will not lie tight against the shoulders 14 and 16, but rather their positions will be determined by the need for the greater control of overall axial length of the element.

Though this new method may be used to make one or more end flanges on cylindrical members used for various purposes, it is particularly useful in the making of cassette posts. The post shown in FIG. 5 may be made of brass or steel and used in a video-cassette as a guide for the tape of that cassette. In that use, the inside length between the end flanges 46 and 48 is critical. By forming the annular shoulders 14 and 16 to a closely controlled separation and pressing the flanges against them, the inside length of the cassette post between flanges is held within very close tolerances. Also, in that use, the diameter of the body is not critical but the surface finish of the cassette post is quite critical and must be very low in micro-inch reading. The surface must be ground and/or lapped. As can be seen from examination of FIG. 2, the maximum diameter of the outermost corner of the outer surfaces 22 and 24 as machined is equal to or less than the outermost diameter of the body of the blank. Therefore, these blanks can be sent axially in a steady stream, one behind the other, through a centerless grinder and can be ground at a rate in the range of 200 to 1500 lineal inches per minute, depending upon the diameter and the material and the surface finish desired. As opposed to this, if the flanges were already formed as is the case with currently used methods of the prior art, the maximum production rate for the required in-feed grinding would probably be about three feeds per minute, resulting in a very low production rate and very high costs.

Various methods may be used to produce desirable ground hardened surfaces between the flanges 46 and 48 of steel members for wear resistence. For example, one method is to copper-plate an entire low-carbon steel blank. The blank is then fed through a centerless grinder to grind off the copper from the body periphery only at a high production rate. The blank is then carburized, with the carbon penetrating only the now unplated cylindrical ground outer surface 13 and is hardened on the carburized cylindrical surface and tempered as desired. This hardened surface is then finish ground and/or polished with a through feed operation, again at a very high production rate. The annular extensions 18 and 20, still soft, are then formed into flanges as described with reference to FIGS. 3 and 4 resulting in a flanged post with a hardened and ground cylindrical body surface.

Another method is to induction harden the cylindrical center section only of a high-carbon steel blank or of a carburized low-carbon steel blank, then finish grind and/or polish the center section, and then form the soft ends 18 and 20 into the flanges 46 and 48.

Another method is to harden the whole cylindrical blank shown in FIG. 2 and then centerless grind for size and surface finish of the cylindrical body surface 13. Then the annular extensions 18 and 20 are softened by induction annealing and thereafter the softened annular extensions 18 and 20 are formed into the end flanges 46 and 48.

In some cases it is desirable to have a flanged element with hardened surfaces both on the cylindrical body section and on the insides of the flanges. Here, the element may be completely formed out of a through-hardenable steel or of a carburized low-carbon steel to the configuration of FIG. 4, by the procedures of this new forming method. Then the element may be hardened in an inert atmosphere to preserve a good finish on the element. It may be furnace hardened or induction hardened.

In some cases, the interior of the element may be threaded at either or each end, or entirely through. Also, the element may have a blind hole bored in from either or each end instead of having a through hole.

I claim:

1. A method of forming at least one end flange on a cylinder having at least one end opening for receiving a flange forming tool comprising the steps of: shaping at least one end of the cylinder to provide an annular shoulder extending from the outside of the cylinder radially substantially perpendicular to the axis of the cylinder, and to provide an annular extension having an outside surface extending from the inside of said annular shoulder substantially to the end of the cylinder, the length of said outside surface being greater than the radial width of said annular shoulder; and then with a flange forming tool applying force against the free end of said annular extensions to move the annular extension until its outside surface is against the annular shoulder to provide a flange extending substantially perpendicularly to the axis of the cylinder.

2. A method in accordance with claim 1 wherein: the outside surface of the annular extension makes an acute angle with the annular shoulder.

3. A method of forming end flanges on a tubular member comprising the steps of: forming two annular shoulders which are spaced apart a predetermined distance, each annular shoulder extending from the outside surface of the tubular member perpendicularly toward the axis of said tubular member, and forming an annular extension at each end of the tubular member, each extension having its outer surface in contact with the corresponding annular shoulder at an acute angle, each annular extension also having a counterbore with the surface of the counterbore being substantially parallel to the outer surface of said annular extension; the length of the outside surface of the annular extension being greater than the width of the corresponding shoulder; and moving a forming tool into the counterbores of each annular extension, said forming tool including a cylindrical portion adapted to enter into the bore of the tubular member and a portion adapted to engage the free end of the annular extension and move the annular extension against the corresponding annular shoulder to provide a tubular member with end flanges extending substantially perpendicularly to the axis of said tubular member.

4. A method of forming a cylindrical member having at least one end flange comprising the steps of: providing a cylindrical blank having at least one end opening for receiving a flange forming tool; shaping the end of the cylinder having the end opening to provide an annular shoulder extending from the cylindrical outside surface of the cylinder radially substantially perpendicular to the axis of the cylinder, and to provide an annular extension having an outside surface extending from the inside of said annular shoulder substantially to the end of the cylinder, the length of said outside surface being greater than the radial width of said annular shoulder; finishing the cylindrical outside surface of the cylinder; and then with a flange forming tool applying force against the free end of said annular extension to move the annular extension until its outside surface is against the annular shoulder to provide a flange extending substantially perpendicularly to the axis of the cylinder.

5. A method in accordance with claim 4 wherein: the outside surface of the annular extension makes an acute angle with the annular shoulder.

6. A method of forming a cylindrical member with end flanges comprising the steps of: providing a cylindrical blank having openings at both ends for receiving flange forming tools; forming two annular shoulders which are spaced apart a predetermined distance, each annular shoulder extending from the outside cylindrical surface of the cylindrical member substantially perpendicularly toward the axis of said cylindrical member, and forming an annular extension at each end of the cylindrical member, each extension having its outer surface in contact with the corresponding annular shoulder at an acute angle, each annular extension also having a counterbore with the surface of the counterbore being substantially parallel to the other surface of said annular extension, the length of the outside surface of the annular extension being greater than the radial width of the corresponding shoulder; finishing the outside cylindrical surface of the cylindrical member; and moving a forming tool into the counterbore of each annular extension, said forming tool including a cylindrical portion adapted to enter into the bore of the cylindrical member and a portion adapted to engage the free end of the annular extension and move the annular extension against the corresponding annnular shoulder to provide a cylindrical member with end flanges extending substantially perpendicularly to the axis of said tubular member.

7. A method of making a tape cassette post comprising the steps of: providing a tubular blank having openings at both ends for receiving flange forming tools; forming two annular shoulders which are spaced apart a predetermined distance to provide an outside cylindrical surface of the tubular member having a predetermined length, each annular shoulder extending from the outside cylindrical surface of the tubular member substantially perpendicularly toward the axis of the tubular member, and forming an annular extension at each end of the tubular member, each extension having its outer surface in contact with the corresponding annular shoulder at an acute angle, each annular extension also having a counterbore with the surface of the counterbore being substantially parallel to the outer surface of said annular extension, the length of the outside surface of the annular extension being greater than the radial width of the corresponding shoulder; hardening and finishing said outside cylindrical surface of the tubular member and providing relatively soft annular extensions; and moving a forming tool into the counterbore of each annular extension, said forming tool including a cylindrical portion adapted to enter into the bore of the tubular member and a portion adapted to engage the free end of the annular extension and move the annular extension against the corresponding annular shoulder to provide a tape cassette post with end flanges.

8. A method of making a tape cassette post in accordance with claim 7 wherein the hardening and finishing said outside cylindrical surface of the tubular member and providing relatively soft annular extensions comprises: copper plating the entire soft tubular member; grinding off the copper from the outside cylindrical surface only; carburizing the tubular member so that carbon penetrates only the now unplated outside cylindrical surface; and finishing the thus hardened outside cylindrical surface.

9. A method of making a tape cassette post in accordance with claim 7 wherein the hardening and finishing said outside cylindrical surface of the tubular member and providing relatively soft annular extensions comprises: induction hardening the outside cylindrical surface, only, of the tubular member, and then finishing said outside cylindrical surface.

10. A method of making a tape cassette post in accordance with claim 7 wherein the hardening and finishing said outside cylindrical surface of the tubular member and providing relatively soft annular extensions comprises: hardening the whole tubular member; centerless grinding the outside cylindrical surface for size and surface finish; and softening the annular extensions by induction annealing.

* * * * *